US010046558B1

(12) United States Patent
Darling

(10) Patent No.: US 10,046,558 B1
(45) Date of Patent: Aug. 14, 2018

(54) METHODS AND SYSTEMS FOR RECOVERY OF FAILED INKJETS

(71) Applicant: XEROX CORPORATION, Norwalk, CT (US)

(72) Inventor: Douglas Dean Darling, Portland, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/680,003

(22) Filed: Aug. 17, 2017

(51) Int. Cl.
*B41J 2/045* (2006.01)

(52) U.S. Cl.
CPC ..... *B41J 2/0451* (2013.01); *B41J 2/04573* (2013.01); *B41J 2/04581* (2013.01); *B41J 2/04586* (2013.01); *B41J 2/04588* (2013.01); *B41J 2/04593* (2013.01); *B41J 2/04596* (2013.01)

(58) Field of Classification Search
CPC .. B41J 2/0451; B41J 2/04573; B41J 2/04581; B41J 2/04588; B41J 2/04593; B41J 2/04596
See application file for complete search history.

(56) References Cited

U.S. PATENT DOCUMENTS

| | | | | |
|---|---|---|---|---|
| 7,681,971 | B2 * | 3/2010 | Berger | B41J 2/04581 347/11 |
| 2005/0030326 | A1 * | 2/2005 | Berger | B41J 2/04581 347/10 |
| 2012/0200624 | A1 * | 8/2012 | Zhou | B41J 2/04501 347/10 |
| 2013/0083107 | A1 * | 4/2013 | Nishikawa | B41J 2/0451 347/10 |

* cited by examiner

*Primary Examiner* — Anh T. N. Vo
(74) *Attorney, Agent, or Firm* — Miller Nash Graham & Dunn LLP

(57) ABSTRACT

A method for recovering missing inkjets in a printhead including determining an inkjet in the printhead is not ejecting ink, purging degassed ink into the printhead, adjusting a pressure in the printhead so that ink drools out of an aperture of each nozzle of the printhead, repeatedly applying a non-firing waveform at a frequency for a predetermined amount of time to the printhead while the ink drools out of the aperture of each nozzle of the printhead, and after the predetermined amount of time, adjusting the pressure in the printhead to a normal printhead pressure.

20 Claims, 5 Drawing Sheets

METHODS AND SYSTEMS FOR RECOVERY OF FAILED INKJETS

TECHNICAL FIELD

This disclosure relates to recovering failed inkjets of an inkjet printhead, and, more particularly, to recovering failed inkjets of an inkjet printhead which are not recovered by purging.

BACKGROUND

Inkjet printheads can fail for a variety of reasons. For example, air bubbles end up in an inkjet printhead or water may evaporate from aqueous ink and create a viscous plug resulting in a failure of a nozzle of the inkjet printhead. Many times, the locations of the air bubbles or viscous plug are such that they can be purged out of the printhead with a normal purge operation. However, sometimes the air bubbles or viscous plugs end up in locations where purging is ineffective.

Unpurgable air bubbles and viscous plugs do not typically happen during normal operation of the printhead. Rather, these generally occur due to a reliability failure event, such as printing with a kinked ink feed tube, with a supply valve closed, or allowing ink in an unused printhead to dry over a long period of time. Unpurgable air bubbles and/or viscous plugs may cause intensity variation, drop placement variations, or simply prevent inkjets from ejecting ink drops.

Traditional solutions have included hiding missing inkjets that are affected by the air bubbles or viscous plugs. As fresh degassed ink is used in the printhead, air bubbles eventually dissolve and/or water will diffuse into viscous plugs of ink, and the missing inkjets will work again. However, this solution only works if there are a small number of inkjets affected. If too many inkjets are affected, the printhead may be removed and simply replaced.

What is needed is an ability to recover inkjets that are affected by unpurgable air bubbles or viscous plugs without removing the printhead or hiding the affected inkjets. This may eliminate printhead replacement and reduce printer downtime.

SUMMARY

One aspect of the disclosure includes a method for recovering missing inkjets in a printhead, including determining an unpurgable air bubble and/or viscous plug is located within the printhead; purging degassed ink into the printhead; adjusting a pressure in the printhead so that ink drools out of an aperture of each nozzle of the printhead; repeatedly applying a non-firing waveform for a predetermined amount of time to the printhead while the ink drools out of the aperture of each nozzle of the printhead; and after the predetermined amount of time, adjusting the pressure in the printhead to a normal printhead pressure.

Another aspect of the disclosure includes a computer readable storage medium having instructions stored thereon that, when executed by a processor of a printhead, cause a printer to determine an unpurgable air bubble and/or viscous plug is located within a printhead; purge degassed ink into the printhead; adjust a pressure in the printhead so that ink drools out of an aperture of each nozzle of the printhead; repeatedly apply a non-firing waveform for a predetermined amount of time to the printhead while the ink drools out of the aperture of each nozzle of the printhead; and after the predetermined amount of time, adjust the pressure in the printhead to a normal printhead pressure.

DETAILED DESCRIPTION OF THE EMBODIMENTS

Figure 1:
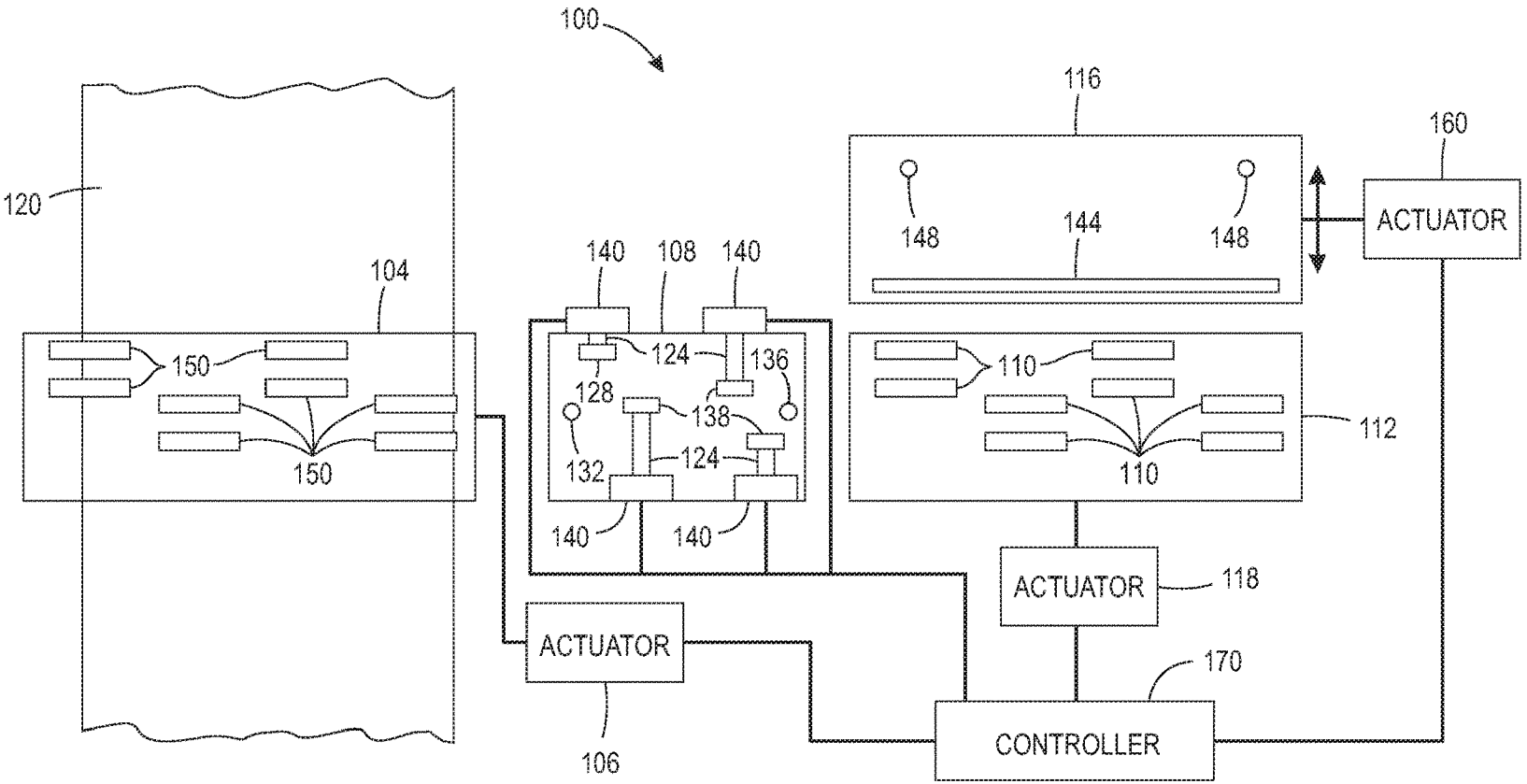
FIG. 1 shows an example embodiment of a purge and wipe system for a printer.

As used herein, the term "printer" generally refers to an apparatus that applies an ink to print media and can encompass any apparatus, such as a digital copier, book-making machine, facsimile machine, multi-function machine, etc., which performs a print outputting function for any purpose. The printer prints ink images on an image receiving member, and the term "image receiving member" as used herein refers to print media or an intermediate member, such as a drum or belt, which carries an ink image and transfers the ink image to a print medium. "Print media" can be a physical sheet of paper, plastic, or other suitable physical substrate suitable for receiving ink images, whether precut or web fed. As used in this document, "ink" refers to a colorant that is liquid when applied to an image receiving member. For example, ink can be aqueous ink, ink emulsions, melted phase change ink, or gel ink that has been heated to a temperature that enables the ink to be liquid for application or ejection onto an image receiving member and then return to a gelatinous state. A printer can include a variety of other components, such as finishers, paper feeders, and the like, and can be embodied as a copier, printer, or a multifunction machine. An image generally includes information in electronic form, which is to be rendered on print media by a marking engine and can include text, graphics, pictures, and the like.

The term "printhead" as used herein refers to a component in the printer that is configured to eject ink drops onto the image receiving member. A typical printhead includes a plurality of inkjets that are configured to eject ink drops of one or more ink colors onto the image receiving member. The inkjets are arranged in an array of one or more rows and columns. In some embodiments, the inkjets are arranged in staggered diagonal rows across a face of the printhead. Various printer embodiments include one or more printheads that form ink images on the image receiving member. Some printer embodiments include a plurality of printheads arranged in a print zone. An image receiving member, such as a print medium or an intermediate member that holds a latent ink image, moves past the printheads in a process direction through the print zone. The inkjets in the printheads eject ink drops in rows in a cross-process direction, which is perpendicular to the process direction across the image receiving member. An individual inkjet in a printhead ejects ink drops that form a line extending in the process direction as the image receiving surface moves past the printhead in the process direction.

As used herein, the terms "electrical firing signal," "firing signal," and "electrical signal" are used interchangeably to refer to an electrical energy waveform that triggers an actuator in an inkjet to eject an ink drop. Examples of actuators in inkjets include, but are not limited to, piezoelectric, and electrostatic actuators. A piezoelectric actuator includes a piezoelectric transducer that changes shape when the firing signal is applied to the transducer. The transducer proximate to a pressure chamber that holds liquid ink, and the change in shape of the transducer urges some of the ink in the pressure chamber through an outlet nozzle in the form of an ink drop that is ejected from the inkjet. In an electrostatic actuator, the ink includes electrically charged particles. The electrical firing signal generates an electrostatic charge on an actuator with the same polarity as the electrostatic charge in the ink to repel ink from the actuator, to eject an ink drop from the inkjet.

As used herein, the term "peak voltage level" refers to a maximum amplitude level of an electrical firing signal. As described in more detail below, some firing signals include a waveform with both positive and negative peak voltage levels. The positive peak voltage level and negative peak voltage level in a firing signal waveform may have the same amplitude or different amplitudes. In some inkjet embodiments, the peak voltage level of the firing signal affects the mass and velocity of the ink drop that is ejected from the inkjet in response to the firing signal. For example, higher peak voltage levels for the firing signal increase the mass and velocity of the ink drop that is ejected from the inkjet, while lower peak voltage levels decrease the mass and velocity of the ejected ink drop. Since the image receiving surface moves in a process direction relative to the inkjet and typically remains at a fixed distance from the inkjet, changes in the velocity of the ejected ink drops affect the relative locations of where the ink drops land on the image receiving surface in the process direction.

As used herein, the term "waveform component" refers to any parameter in the shape or magnitude of an electrical firing signal waveform that is adjusted to affect the velocity of an ink drop that is ejected from an inkjet in response to the generation of the waveform with the adjusted component parameter. The peak voltage level and peak voltage duration are examples of waveform components in electrical firing signals. As described below, an inkjet printer adjusts one or more waveform components including either or both of the peak voltage level and peak voltage duration to adjust the ejection velocities of ink drops on a drop-by-drop basis during an imaging operation. Since different ink drop ejection patterns result in variations of the ink drop velocity due to the characteristics of the inkjet and printhead, the adjustments to the waveform components enable more accurate placement of ink drop patterns on the image receiving surface during the imaging operation.

To both purge air bubbles and clean ink from the printheads in the printer, a purge and wipe system 100 is used. An example of such a system is shown in FIG. 1. The system includes a printhead assembly 104, a wiper assembly 108, a purge cap assembly 112, a purge tray 116, and a controller 170. The printhead assembly 104 is an arrangement of a plurality of printheads that is located within a printer. The web 120 moves past the printhead assembly during printing. The printheads 150 may be configured in a staggered printhead array as provided in previously known printers. However, other configurations may also be used. An actuator 106 is operatively connected to the printhead assembly 104 to move the assembly bi-directionally as indicated by the arrows adjacent the assembly 104 in FIG. 1.

The wiper assembly 108 includes four actuators 140, each of which is operatively connected to a rotatable cam 128 by a rotating shaft 124. The cams are configured with wipers as described below. The actuators are operated to rotate the wipers through a reservoir of cleaning fluid beneath the cams 128 and then to a position that enables each wiper to wipe the faces of the printheads in a single row of the printhead assembly 104. The removed ink falls into the reservoir, which has a slanted floor that enables the removed ink to slide along the floor to a drain 136. Cleaning fluid is provided to the reservoir through supply port 132. Purge cap assembly 112 includes purge caps, which are typically made of compliant material, such as silicone. These caps are operatively connected to an actuator 118 that lifts the caps into engagement with the faces of printheads when the printhead assembly 104 is moved to a position opposite the printhead seal assembly. The caps have a drain to direct purged ink away for collection. During purge, pressure is then applied to the internal reservoirs, manifolds and channels in the printheads to urge ink through the printheads and onto the faces of the printheads. In alternate embodiments, a vacuum is applied to the sealed purge caps to urge ink through the printheads. Purged ink is collected and drained from purge caps 110. The purge caps 110 are then lowered by the actuator 118 to enable actuator 160, which is operatively connected to the purge tray 116, to be operated by the controller 170 to move the purge tray 116 between the sealing cap assembly 112 and the printhead assembly 104. A wiper 144 is provided within the purge tray 116 to be close to the faces of the printheads 150 in the printhead assembly 104. When the assembly 104 is opposite the seal assembly 112, the wiper 144 in the tray 116 removes a substantial amount of ink remaining on the faces of the printhead after the purge. The floor of the purge tray 116 slants to the drains 148 to enable the removed purged ink to be collected in a waste receptacle, which is fluidly connected to the drains 148.

The system of FIG. 1 is operated in the following manner to perform a purge operation. The purge operation begins with the controller 170 operating the actuator 106 to move the printhead assembly past the wiper assembly 108 while the controller 170 operates the actuators 140 to rotate the cams to position the wipers within the cleaning fluid reservoir. The controller 170 stops the printhead assembly 104 when it is opposite the sealing cap assembly 112. After the controller 170 operates the actuator 118 to raise the purge caps 110 to seal the printhead faces, the ink is purged from the printheads. Purged ink is collected and drained from the caps 110. The controller 170 then operates the actuator 118 to lower the sealing caps and the controller operates actuator 260 to move the purge tray to the position between the sealing cap assembly 112 and the printhead assembly 104. As the purge tray moves to the position opposite the printhead assembly, the wiper 144 removes a substantial portion of the purged ink remaining on the printhead faces. The controller 170 operates the actuator 160 to return the purge tray to its original position and during this retraction, the wiper 144 again removes ink from the printhead faces. Once the tray 116 returns to its original position, the controller 170 operates the actuators 140 to rotate the cams 128 so the wipers are positioned in the return path of the printheads to the printing position. As the controller 170 operates the actuator 106 to return the printhead assembly 104 to the printing position, the printhead assembly moves past the wipers on the cams 128 and the wipers contact the faces of the printheads. The wiping action coupled with the cleaning fluid on the wipers removes the remaining purged ink from the printhead faces. When the printhead assembly reaches the printing position from which it started, the controller 170 stops the printhead assembly 104 and the purging operation is completed. The printhead assembly is now ready for printing.

The controller 170 can be implemented with general or specialized programmable processors that execute programmed instructions, for example, printhead operation. The instructions and data required to perform the programmed functions are stored in a memory that is associated with the processors or controllers. The processors, their memories, and interface circuitry configure the printer to form ink images, and, more particularly, to control the operation of inkjets in the printheads 150 to eject ink drops to form printed images. These components are provided on a printed circuit card or provided as a circuit in an application specific integrated circuit (ASIC). Each of the circuits can be implemented with a separate processor or multiple circuits are implemented on the same processor. In alternative configurations, the circuits are implemented with discrete components or circuits provided in very large scale integration (VLSI) circuits. Also, the circuits described herein can be implemented with a combination of processors, FPGAs, ASICs, or discrete components.

Figure 2:
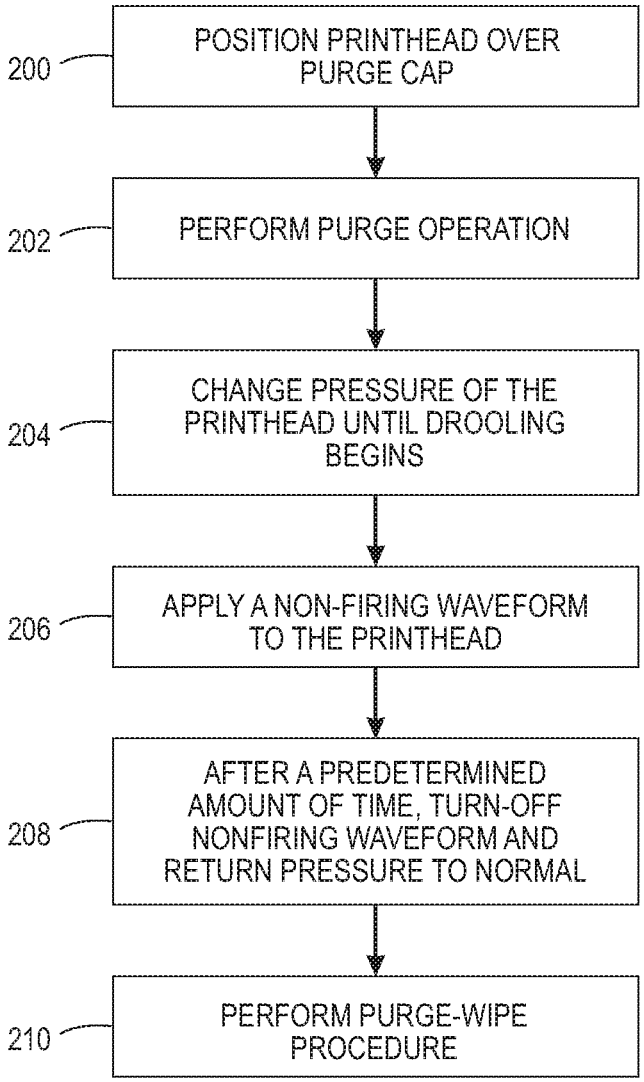
FIG. 2 shows a flowchart of a process for recovering inkjets, that were unrecoverable by purging, according to embodiments of the disclosure.

FIG. 2 illustrates a process for in-situ recovery of failed inkjets that are not recoverable by the purging operation discussed above. The printer or user may determine that inkjets are missing and not ejecting ink. The process may be initiated manually when a user notices drops are missing on the output prints. Or, if the printer has scanning capability, the process may be initiated automatically by the printer. A normal purge operation may be performed, and then, if inkjets are still missing, the process of FIG. 2 is performed.

Initially, the printhead 150 is positioned 200 over the purge caps 110 used for collecting purged ink. Ink is purged through the printhead 202 to ensure that there is fresh degassed ink within the printhead 150. The fresh degassed ink is required to dissolve air bubbles present within some portions of the printhead 150.

Once the purge operation has been performed 204, the pressure of the printhead 150 is changed 204 until the meniscus of each aperture of the inkjet of the printhead 150 breaks and ink beings to drool out of the apertures. The pressure of the printhead 150 may be changed by increasing the printhead 150 back-pressure, decreasing the applied vacuum to the printhead 150, or increasing vacuum applied to the purge caps. Drooling replenishes the supply of fresh degassed ink in the vicinity of the air bubbles or viscous plug. In some embodiments, ink may flow at a higher rate. However, at high flowrates of ink, the ink usage is much higher, and more ink is wasted. When the ink is just barely drooling, i.e., the pressure is a few inches of water above the point where the meniscus breaks, the amount of wasted ink is minimized.

A non-firing voltage waveform is repeatedly applied 206 at a specific frequency to all of the inkjets while the ink continues to drool out of the apertures into the purge caps for a predetermined amount of time. The non-firing waveforms are repeatedly applied at the same or lower frequency as the drop firing frequency. For example, in some embodiments, the plurality of non-firing waveforms are applied at a frequency of 12 kHz. The non-firing voltage waveform is a waveform that is not strong enough to eject ink from the printhead 150. In some embodiments, the predetermined amount of time may be 30 minutes. In other embodiments, the predetermined amount of time may be 15 minutes or an hour, depending on the severity of the air bubbles or viscous plug.

The non-firing voltage waveform increases the mass transfer rate between the fresh degassed ink and the air bubble or viscous plug, reducing the amount of time to eliminate the air bubble or viscous plug. The non-firing voltage waveform also results in vibrations of the inkjet, which may detach an air bubble or viscous plug from a wall of the inkjet so that the air bubble or viscous plug enter in the flow of ink during drooling. In some embodiments, the non-firing voltage waveform is established for a given printhead during production.

After the predetermined amount of time, the non-firing waveform is shut-off and the printhead 150 is retuned 208 to normal pressure. This results in drooling ceasing from the apertures. However, there will be ink on the faceplate on the printhead 150, so a normal purge-wipe procedure is performed 210 to reset the meniscus in each of the apertures of the inkjet and clean the faceplate. At this point, the printhead 150 is ready to print.

Figure 3:
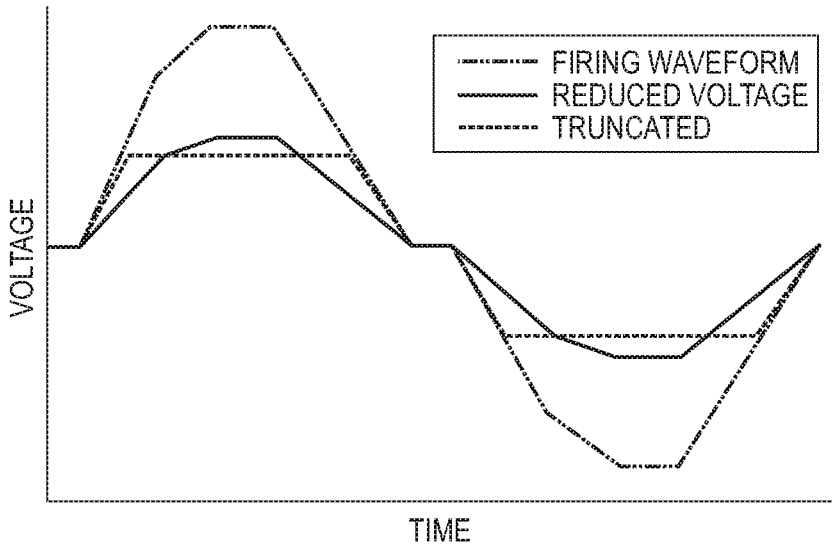
FIG. 3 shows example non-firing waveforms, according to embodiments of the disclosure

FIG. 3 illustrates various examples of non-firing waveforms. The non-firing waveform is determined empirically during production of the printhead. To begin with, a firing waveform is applied to the inkjets. Then, the firing waveform is reduced, truncated, or elongated until ink drops are no longer ejected from the inkjets. FIG. 3 illustrates the firing waveform, a reduced voltage waveform, and a truncated waveform. As mentioned above, the non-firing waveforms are determined during production of the printhead 150.

Figure 4:
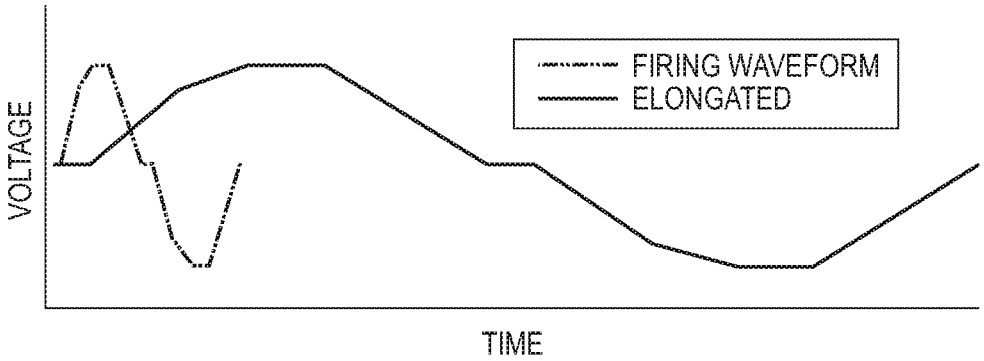
FIG. 4 shows an elongated non-firing waveform, according to some embodiments of the disclosure.

FIG. 4 illustrates a firing waveform and an elongated waveform as the non-firing waveform. Elongation of the firing waveform allows the inkjet driver to be fully displaced, but the frequency of application needs to be lower.

Figure 5:
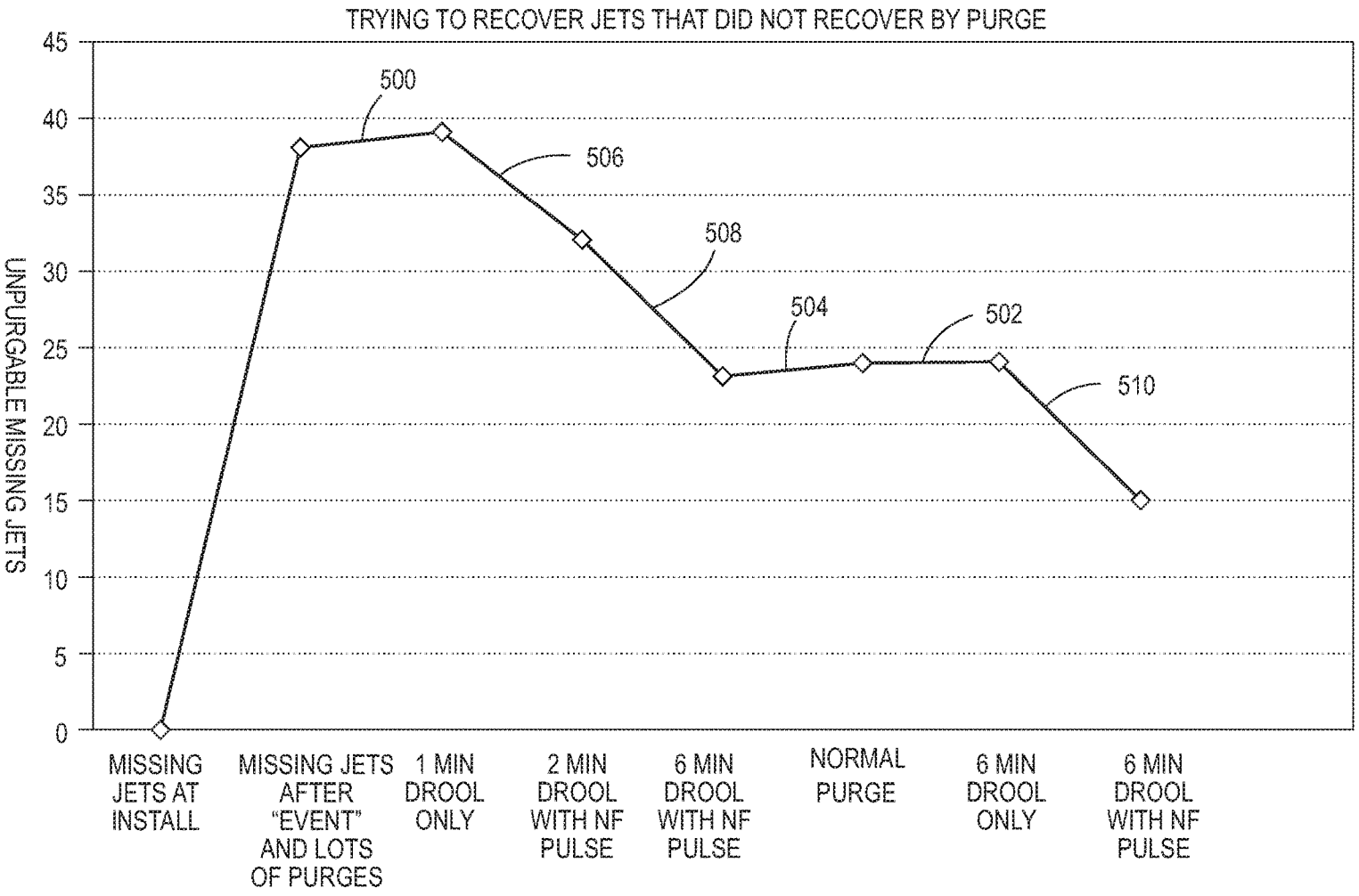
FIG. 5 shows an example test for recovering missing inkjets of a printer.

FIG. 5 illustrates an example plot demonstrating the effectiveness of the embodiments of the disclosure. In this example, the event that caused the unpurgable bubbles was printing with the ink supply valve closed. After the event, the printhead was purged until the number of missing inkjets was no longer improving. As indicated by reference numbers 500 and 502, drooling alone did not help reduce the number of jets. Purging, as indicated by reference number 504, also did not help reduce the number of missing jets. However, as seen by reference numbers 506, 508, and 510, drooling while applying a non-firing (NF) waveform, per the method discussed above with respect to FIG. 2, helped reduce the number of missing inkjets.

Figure 6:
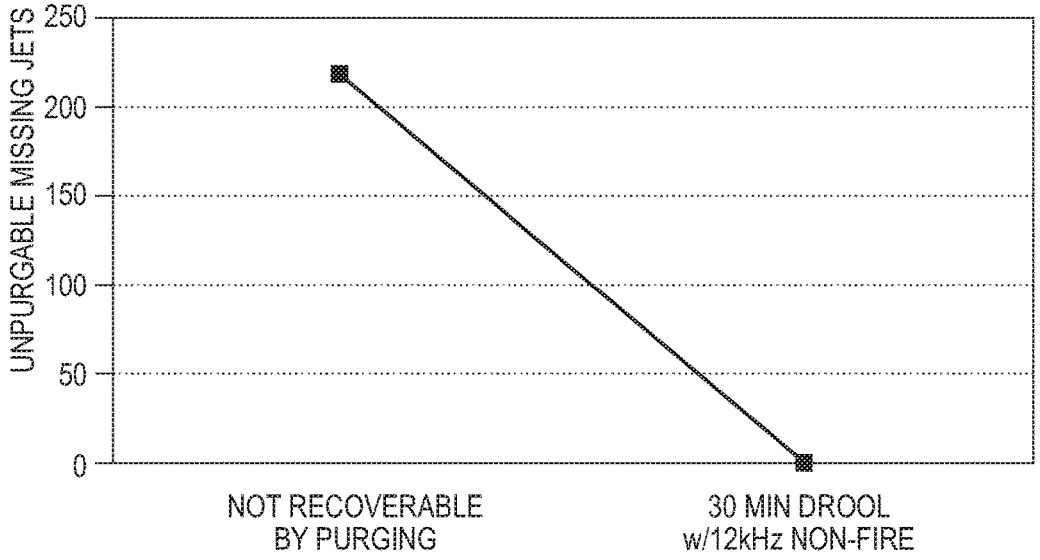
FIG. 6 shows an example test of the process shown in FIG. 2.

FIG. 6 illustrates additional example results for reviving missing jets using the above-discussed method. FIG. 6 illustrates applying a non-firing waveform during drooling for 30 minutes continuously. After the 30 minutes, all of the missing jets were recovered.

Figure 7:
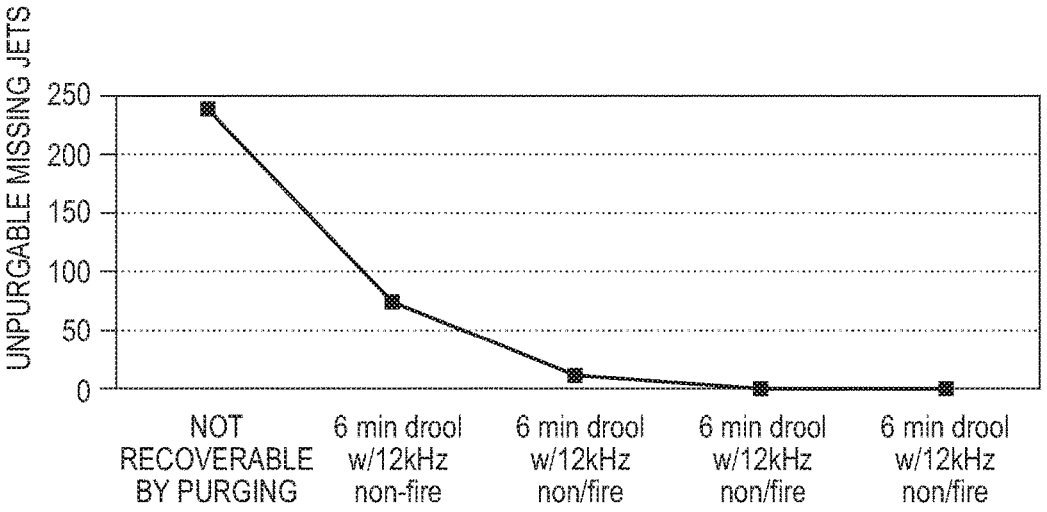
FIG. 7 also shows an example test of the process shown in FIG. 2.

FIG. 7 illustrates another example test to indicate approximately how long it takes to recover all the missing jets using the above-described process. In the plot of FIG. 7, the test was paused every six minutes to determine how many jets were still missing. As seen in FIG. 7, after 18 cumulative minutes, all of the missing jets were recovered using the above-described process. This process will allow the printer to recover unpurgable bubbles and viscous plugs, rather than operating the printhead with some of the inkjets missing, or potentially having to completely remove the printhead and replace it due to an excessive number of missing inkjets.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method for recovering missing inkjets in a printhead, comprising:

determining an inkjet in the printhead is not ejecting ink;

purging degassed ink into the printhead;

adjusting a pressure in the printhead so that ink drools out of an aperture of each nozzle of the printhead;

repeatedly applying a non-firing waveform at a frequency for a predetermined amount of time to the printhead while the ink drools out of the aperture of each nozzle of the printhead; and after the predetermined amount of time, adjusting the pressure in the printhead to a normal printhead pressure.

2. The method of claim 1, further comprising performing a purge-wipe procedure to each nozzle of the printhead after the pressure in the printhead is at the normal printhead pressure.

3. The method of claim 1, further comprising positioning the printhead over a cap used for collecting purged ink prior to purging degassed ink in the printhead.

4. The method of claim 3, further comprising positioning the printhead over a print media receptacle after adjusting the pressure in the printhead to the normal printhead pressure.

5. The method of claim 1, wherein adjusting the pressure in the printhead so that ink drools out of the aperture of each nozzle includes increasing a printhead back pressure.

6. The method of claim 1, wherein adjusting the pressure in the printhead so that ink drools out of the aperture of each nozzle includes decreasing an applied vacuum.

7. The method of claim 1, wherein the frequency is less than or equal to the drop firing frequency.

8. The method of claim 1, wherein the frequency is 12 kHz.

9. The method of claim 1, wherein the non-firing waveform is an elongated firing waveform.

10. The method of claim 1, wherein the non-firing waveform is a truncated firing waveform.

11. A computer readable storage medium having instructions stored thereon that, when executed by a processor of a printhead, cause a printer to:

determine an unpurgable air bubble and/or viscous plug is located within a printhead;

purge degassed ink into the printhead;

adjust a pressure in the printhead so that ink drools out of an aperture of each nozzle of the printhead;

repeatedly apply a non-firing waveform at a frequency for a predetermined amount of time to the printhead while the ink drools out of the aperture of each nozzle of the printhead; and after the predetermined amount of time, adjust the pressure in the printhead to a normal printhead pressure.

12. The computer-readable medium of claim 11, further including instruction to cause the printer to perform a purge-wipe procedure to each nozzle of the printhead after the pressure in the printhead is at the normal printhead pressure.

13. The computer-readable medium of claim 11, further including instruction to cause the printer to position the printhead over a cap used for collecting purged ink prior to purging degassed ink in the printhead.

14. The computer-readable medium of claim 13, further including instruction to cause the printer to position the printhead over a print media receptacle after adjusting the pressure in the printhead to the normal printhead pressure.

15. The computer-readable medium of claim 11, wherein adjusting the pressure in the printhead so that ink drools out of the aperture of each nozzle includes increasing a printhead back pressure.

16. The computer-readable medium of claim 11, wherein adjusting the pressure in the printhead so that ink drools out of the aperture of each nozzle includes decreasing an applied vacuum.

17. The computer-readable medium of claim 11, wherein the predetermined amount of time is 30 minutes.

18. The computer-readable medium of claim 11, wherein the frequency is less than or equal to the drop firing frequency.

19. The computer-readable medium of claim 11, wherein the specified frequency is 12 kHz.

20. The computer-readable medium of claim 11, wherein the non-firing waveform includes a voltage less than a firing waveform.

* * * * *